US005401428A

United States Patent [19]

Kalota et al.

[11] Patent Number: 5,401,428

[45] Date of Patent: Mar. 28, 1995

[54] WATER SOLUBLE METAL WORKING FLUIDS

[75] Inventors: Dennis J. Kalota, Fenton; Larry A. Spickard, Chesterfield; Skippy H. Ramsey, Fenton, all of Mo.

[73] Assignee: Monsanto Company, St. Louis, Mo.

[21] Appl. No.: 133,720

[22] Filed: Oct. 8, 1993

[51] Int. Cl.[6] ..... C10M 173/02; C10M 149/04

[52] U.S. Cl. ..... 252/49.3; 252/33.6; 252/51.5 R; 72/42

[58] Field of Search ..... 252/493; 72/42

[56] References Cited

U.S. PATENT DOCUMENTS

| | | | |
|---|---|---|---|
| 3,945,931 | 3/1976 | Bussi et al. | 72/42 |
| 4,039,460 | 8/1977 | Koch | 72/42 |
| 4,053,426 | 10/1977 | Davis et al. | 72/42 |
| 4,144,188 | 3/1979 | Sato | 252/389 R |
| 4,172,802 | 10/1979 | Rieder | 72/42 |
| 4,687,590 | 8/1987 | Haack | 252/75 |
| 4,724,124 | 2/1988 | Ritschel et al. | 252/49.3 |
| 4,729,841 | 3/1988 | Ritschel et al. | 252/49.3 |
| 4,971,724 | 11/1990 | Kalota et al. | 252/390 |
| 5,112,507 | 5/1992 | Harrison | 252/51.5 A |

FOREIGN PATENT DOCUMENTS

| | | |
|---|---|---|
| 2252103 | 7/1992 | United Kingdom . |

*Primary Examiner*—Ellen M. McAvoy
*Attorney, Agent, or Firm*—R. C. Loyer

[57] ABSTRACT

There are disclosed novel water soluble metal working fluids comprising polyaspartic acid and salts thereof useful as a lubricant in process to cut, bend, grind and shape both ferrous and non-ferrous metal. The polyaspartic acid and salts thereof are particularly advantageous in that the fluids can be easily disposed of after use with special treatment because polyaspartic acid and salts thereof are readily biodegradable.

15 Claims, No Drawings

WATER SOLUBLE METAL WORKING FLUIDS

This invention relates to novel water soluble metal working fluids which are biodegradable and do not require reclaiming. More particularly, this invention relates to polyamido salts useful in cutting, grinding, shaping and other metal working operations which require a lubricant. The disclosed polyamido compounds are also anticorrosive and environmentally more acceptable than current oil based fluids.

BACKGROUND OF THE INVENTION

Because of the concern for environmental factors, previously known oil containing metal working fluids require reclaiming or disposal other than by discharging them to common sewage treatment systems. In some cases the cost of disposal has become a major cost in that the cost of disposal approaches the initial cost of the fluid.

Various fluids have been recently proposed to be substituted for oil containing metal working fluids such as primary amides, ethylenediamine tetraacetic acid, fatty acid esters, and alkanolamine salts. Such compounds can be replenished during use by dissolving tablets containing such compounds during the useful life of the fluid. See U.S. Pat. No. 4,144,188 to Sato.

Amines have also been found useful in cutting oils as antibacterial agents. Such amines include anilinoamines and arylalkylamines such a p-benxylaminophenol. See EPO 90-400732 to Noda et al.

As noted above one of the problems occurring in industry is the proper disposal of metal working fluids. The above mentioned amines are removed from the fluids by biodegradation, requiring facilities such as settling tanks, treatment tanks and sludge treatment tanks. Such a system is disclosed in Japanese Patent 03181395. Other methods of waste disposal and oil removal systems are employed to comply with environmental standards.

Worker sanitation is always an issue with presently employed oil containing water soluble metal working fluids. Such fluids unavoidably come in contact with workers using the fluids in cutting, bending, threading and other metal working applications. Such oil containing fluids create a mist at the site of the work piece being operated on and such mist travels through the air in the vicinity of the machine and the operator thereof. Some attempts have been made to reduce the mist problem as is noted in British Patent 2,252,103. There is disclosed therein a polymeric thickener comprising a copolymer of acrylamide, sodium acrylate and N-n-octyl acrylamide. The copolymer is formulated with water soluble and water insoluble monomer.

Because of the misting and drift thereof in the work place employing the commonly employed water soluble metal working fluids, there is usually associated with such work place a distinctive odor which permeates the entire area. Usually such odor is unpleasant and is tolerated as a condition which is unavoidable.

There is needed a highly biodegradable, odorless, non-misting, water soluble metal working fluid, particularly useful in cutting operations. Such a fluid would dispense with the need for disposal and provide the work place with a more sanitary and acceptable atmosphere in which to work.

BRIEF DESCRIPTION OF THE INVENTION

There has now been discovered a highly biodegradable, odorless, non-misting, water soluble metal working fluid comprising polyaspartic polymers selected from the group consisting of the acid, salts and amides derived from the polymerization of aspartic acid. Such polymers are typically produced by the thermal condensation of L-aspartic acid to provide polysuccinimide which is then hydrolyzed by known means to produce the water soluble, highly biodegradable polyaspartic acid or salts. Such polymers commonly have a molecular weight in the range of from about 8500 to about 10,600.

When dissolved in water, such polymers provide a highly desirable water based metal working fluid useful in such operations as cutting, threading, bending, grinding and shaping of various ferrous and non-ferrous metals.

DETAILED DESCRIPTION OF THE INVENTION

Typically, the metal working fluids of this invention comprise polyaspartic acid or a salt thereof in concentrations in the range of from about 5% to about 50%, by weight in water. Preferred compositions of this invention comprise from about 5% to about 15% polyaspartic acid or salt thereof in water.

Since polyaspartic acid or the salts thereof are readily soluble in water there is no need for special processes to incorporate useful amounts. While metal working fluids of this invention may comprise only polyaspartic acid a salt or amide thereof in water, it is common practice to include other ingredients which enhance the properties desired in such fluids. Therefore, compositions of this invention may also include surfactants, extreme pressure agents, buffers, thickeners, antimicrobial agents and other adjuvants commonly employed in such compositions.

The polyaspartic acid of this invention is provided by the thermal condensation of aspartic acid. Many different process are known for such purpose. For example, there has recently been discovered a continuous process employing a tray dryer wherein the aspartic acid is introduced into the top level of trays which cyclically travel in the horizontal plane to deliver the reacting material to the next adjacent lower level of trays. The residence time in the dryer is controlled by the number of tray levels, circulation of heated gas, such as air, through the dryer and temperature. The temperature in such a device is usually in the range of from about 200° C. to about 350° C. with a residence time in the range of from about 1.5 to about 3 hours. A typical tray dryer is commercially available from the Wyssmont Company, Incorporated, Fort Lee, N.J. Another tray dryer which may be employed in such process is a tray dryer commercially produced by Krauss Maffe of Florence Ky. In the Krauss Maffe tray dryer, heated trays are stationary and the reactant is moved across each plate by axially rotating plows or shovels. The reactant alternatively falls from one tray level to the next at the internal or external edge of the tray. The reactant is directly heated by the trays.

While there are several isomers of aspartic acid which may be employed to prepare polyaspartic acid, such as D-, L- or DL-aspartic acid, it is preferred herein to employ L-aspartic acid.

If a catalyst is employed the reaction, residence time in the dryer may be less, in the range of from about 1 to about 1.5 hours, depending upon other factors noted above. It has recently been discovered that carbon dioxide in the circulating gas catalyzes the thermal condensation when present in amounts of at least about 5%, by volume. Amounts of carbon dioxide in the circulated gas is usually about 10%, by volume.

Various reactors can be employed to produce the polyaspartic acid of this invention. Typical reactors include the List reactor commercially available from Aerni, A. G. Augst, Switzerland and the Littleford Reactor such as the model FM 130 Laboratory Mixer and larger production models available from the Littleford Bros. Inc., Florence, Ky.

The Littleford mixer provides sufficient agitation to produce a fluid bed condition and may be equipped with a chopper to break up any lumps or clumps of particles that develop and to provide additional shear forces to the fluid bed. The agitation provided by the mixer is sufficient to maintain the particles in a substantially free-flowing state throughout the time period of the reaction. Typically, the Littleford mixer is operated at a temperature of at least about 180° C. and is capable of maintaining the heated bed at a temperature in the range of about 180° C. to about 250° C. or higher for a time sufficient to polymerize the aspartic acid. The mixer is desirably equipped to provide a purge gas stream through the reactor. In accordance with this invention the gas stream is provided with sufficient amounts of carbon dioxide so as to catalyze the condensation reaction, thus greatly reducing the amount of time to reach complete polymerization of the aspartic acid.

The usual thermal condensation reaction of aspartic acid produces the polysuccinimide intermediate. The intermediate is easily hydrolyzed by alkaline solution to polyaspartic acid or salt. It has been found that a 12%, by weight solution of an alkali metal base, such as sodium hydroxide, optimally converts the intermediate to the desired polyaspartic acid or salt.

Any of the water soluble salts of the polyaspartic acid produced by the thermal condensation of L-aspartic acid may be employed in the metal working composition of this invention. Typical salts include alkali metal salts, ammonium, organic ammonium and mixtures thereof. The term "alkali metal" encompasses lithium, sodium., potassium ,cesium and rubidium. The organic ammounium salts include those prepared form the low molecular weight organic amines, i.e. having a molecular weight below about 270. Organic amines include the alkyl amines, alkylene amines, alkanol amines. Typical organic amines include propylamine, isopropylamin, ethylamine, isobutylamine, n-amylamine, hexylamine heptylamine, octylamine nonylamine, decylamine, undeclyamine, dodecylamine,hexadecylamine, heptadecylamine and ocatdecylamine.

No matter which reactor is employed, the polyaspartic acid or salt thereof produced by the thermal condensation of L-aspartic acid, is useful in this invention. It has been discovered that this polymer provides sufficient lubrication to permit metal working operations on ferrous and non-ferrous metals.

The water based metal working fluids of this invention are particularly advantageous in that there is no odor associated with water solutions of polyaspartic acid or salts thereof. Further, it has been observed that the fluid does not create a mist around the tool working area as is common with water based oil containing fluids. Because of the lack of mist formation the work area is maintained virtually free of deflected fluid leaving the machinery and worker substantially free of contamination by the metal working fluid. The water based metal working fluids of this invention are most advantageous in that the active ingredient, polyaspartic acid or salts have been found to have a rapid rate of biodegradation. The biodegradability of the metal working fluids of this invention allows their disposal through normal means as by discharge into a sewage treatment system. The cost advantages of such a fluid are obvious in view of the environmental concerns resulting in alternative means of disposal.

Tests with non-ferrous metals such as brass and copper indicate that not only is the work place relatively free of contamination but that the work piece remains relatively free of discoloring deposits. In fact, it has been observed that the aqueous solutions of the salts of polyaspartic acid are corrosion inhibitors as indicated by U.S. Pat. No. 4,971,724 to Kalota et al. Therefore, metals, particularly ferrous metals, are free of harmful deposits and are, in fact protected from corrosion by the metal working fluids of this invention.

The metal working fluids of this invention are useful in the various metal working applications such as were noted above with any number of types of metals. In particular they are useful in working ferrous metals such as black iron, steel, and stainless steel. Non-ferrous metals which can be worked with fluids of this invention are copper, brass, and aluminum. Such metals are safely worked with lubricity supplied by the water based fluids of this invention.

DESCRIPTION OF THE PREFERRED EMBODIMENTS

EXAMPLE 1

In the following example, a laboratory model of a tray dryer was employed having two trays which passed the reactant material from one to the other thereby simulating the conditions of a commercially available tray dryer referred to above. The reactant material was passed from one tray to the other so as to equal the desired number of tray levels of the commercial model. The tray dryer, simulating the Wyssmont Turbo Dryer, available from the Wyssmont Company, Fort Lee, N.J. was operated with the addition of 1 kg of L-aspartic acid per tray level at a depth of 2.5 cm on the trays. A total of 28 tray levels was employed. Circulated air temperature through the dryer of 305° C. was maintained throughout the experiment. Air velocity was maintained at 114.3 meters per minute and tray rotation was set at 3 minutes per revolution. An amount of carbon dioxide was fed into the air supply to provide a total amount of 10 percent, by volume, carbon dioxide in the air contacting the material on the trays. Samples were taken from the trays at various reaction times and analyzed for the amount of conversion to polymer, pH, color (APHA), and molecular weight. The data obtained appears in Table I below.

TABLE I

| Sample No. | Time (min) | Mol. wt. | Color | pH | % Conv. Polymer |
|---|---|---|---|---|---|
| 1 | 30 | 9402 | 112 | 9.17 | 53.66 |
| 2 | 64 | 9333 | 471 | 9.82 | 99.00 |
| 3 | 70 | 9263 | 565 | 9.26 | 99.06 |

TABLE I-continued

| Sample No. | Time (min) | Mol. wt. | Color | pH | % Conv. Polymer |
|---|---|---|---|---|---|
| 4 | 90 | 8792 | 1069 | 10.01 | 99.16 |

EXAMPLE 2

An important factor in the use of metal working fluids is the amount of foam produced by the action of pumps, sprays and flow of such fluids. To demonstrate the foaming properties of the fluids of this invention a standard ASTM method for foaming properties (D892) was perfomed. Tests were run with 5% and 27% aqueous solutions of the sodium salt of polyaspartic acid. The test duration was 5 minutes and the data collected at various temperatures and concentrations of polyaspartic acid is shown below in Table II.

TABLE II

| Temp° | Cycle | Foam Tendency | Foam Stability |
|---|---|---|---|
| | | 5% Concentration | |
| 24 | 1 | no foam | — |
| 93 | 2 | no foam | — |
| 24 | 3 | no foam | — |
| | | 27% Concentration | |
| 24 | 1 | no foam | — |
| 93 | 2 | no foam | — |
| 24 | 3 | no foam | — |

As indicated by the results of this test, metal working fluids of this invention are virtually free of foaming tendency.

EXAMPLE 3

A Falex test (ASTM D3233B) was run at a fluid temperature of 49° C. at 290 RPM and a concentration of 5%, by weight, of the sodium salt of polyaspartic acid. The data obtained is shown below in Table III.

TABLE IIIA

| | 5% Concentration | | |
|---|---|---|---|
| Load lbf | Time (min) | Torque - lbf | |
| 300 | 5 | 30 | 29 |
| 500 | 1 | 44 | 46 |
| 750 | 1 | 51 | 48 |
| 1000 | 1 | 53 | 51 |
| 1250 | 1 | 53 | 53 |
| 1500 | 1 | 53 | 52 |
| 1750 | 1 | 53 | 50 |
| 2000 | — | 54 | — |

There was detected squealing between 300 and 750 lbf and smoke appeared at 750 lbf and throughout the test. The test was terminated at 2000 lbf load due to load fluctuations and noise. There was 50%, by weight evaporation of the sample and a black tacky build-up was observed on parts. The final liquid temperature was about 54° C.

A second Falex test was run with a working fluid concentration of 27%, by weight, of the sodium salt of polyaspartic acid. The data obtained is shown below in Table IIIB.

TABLE IIIB

| | 27% Concentration | | |
|---|---|---|---|
| Load lbf | Time (min) | Torque - lbf | |
| 300 | 5 | 24 | 22 |
| 500 | 1 | 30 | 30 |
| 750 | 1 | 38 | 38 |

TABLE IIIB-continued

| | 27% Concentration | | |
|---|---|---|---|
| Load lbf | Time (min) | Torque - lbf | |
| 1000 | 1 | 42 | 40 |
| 1250 | 1 | 49 | 46 |
| 1500 | 1 | 51 | 50 |
| 1750 | 1 | 55 | 53 |
| 2000 | 1 | 55 | 55 |
| 2250 | — | 60 | — |

There was detected squealing between 300 and 1250 lbf and smoking began at 1500 lbf load and throughout the test. The test was stopped at 2250 lbf load due to load fluctuations and noise. No evaporation or gummy build-up was observed. The final liquid temperature was 70° C.

EXAMPLE 4

A rust test (ASTM D3603) was run with a horizontal disc mild steel coupon. No rust was detected at either 5% or 28%, by weight, aqueous solution concentration of the sodium salt of polyaspartic acid.

EXAMPLE 5

A four-ball wear test was conducted with a 40 kg. force at 1200 RPM at 5% and 28%, by weight, concentrations of the sodium salt of polyaspartic acid. The test was conducted at room temperature for 1 hour. The data collected is presented below in Table IV.

TABLE IV

| | |
|---|---|
| Concentration 5% | 28% |
| Initial Temp °F. 84 | 83 |
| Final Temp °F. 183 | 135 |
| Ave. Wear Scar Dia. mm 1.51 | 1.27 |

EXAMPLE 6

A four-ball coefficient of friction test (Falex 6) was run employing 5% and 28%, by weight, concentrations of the sodium salt of polyaspartic acid. The tests were run at 1200 RPM at ambient initial temperature. The data obtained in the tests are shown below in Table V.

TABLE V

| Time | Temp °F. | | Coefficient of Friction | |
|---|---|---|---|---|
| (min) | 5% | 28% | 5% | 28% |
| 0 | 84 | 83 | 0.077 | 0.072 |
| 10 | | | 0.280 | 0.121 |
| 20 | | | 0.213 | 0.133 |
| 30 | | | 0.175 | 0.087 |
| 40 | | | 0.160 | 0.104 |
| 50 | | | 0.155 | 0.084 |
| 60 | 183 | 135 | 0.170 | 0.100 |
| | | | ave. 0.176 | ave. 0.1 |

EXAMPLE 7

A load wear index test was run (ASTM D2783) to determine the load wear index of 5% and 28%, by weight, aqueous solutions of the sodium salt of polyaspartic acid. The data obtained in the test in presented below in Table VI.

TABLE VI

| Applied Load kgf | Scar Diameter 5% | Scar Diameter 28% | Corrected Load kgf 5% | Corrected Load kgf 28% |
|---|---|---|---|---|
| 32 | 0.62 | 0.57 | | |
| 40 | 0.78 | 0.65 | 14.305 | 15.560 |
| 50 | 0.90 | 0.67 | 15.714 | 18.373 |
| 63 | 0.99 | 0.78 | 17.868 | 24.001 |
| 80 | 1.01 | 0.88 | 22.105 | 28.057 |
| 100 | 1.13 | 0.97 | 29.795 | 34.197 |
| 126 | 1.19 | 1.11 | 35.859 | 41.774 |
| 160 | 1.34 | 1.20 | 46.341 | 49.680 |
| 200 | 1.40 | 1.34 | 56.590 | 63.192 |
| 250 | 1.60 | 1.60 | 72.933 | 76.199 |
| 315 | weld | weld | 85.930 | 85.930 |
| total | | | 397.440 | 436.963 |
| total compensation line | | | 0 | 0 |
| Total A | | | 397.440 | 436.963 |
| Load Wear Index Total A | | | 39.7 | 43.7 |

EXAMPLE 8

The product of Example 1 was hydrolyzed by a 12% solution of sodium hydroxide. A series of aqueous solutions at various concentrations were prepared from the sodium salt which were subjected to a thermal/hydrolytic stablility test. The test was conducted over a period of 11 days at 78° C. in glass containers. The stability was measured in terms of pH. The results of the test appear in Table VII below.

TABLE VII

| Concentration %, by wt. | pH Initial | pH End | Density-g/ml Initial | Density-g/ml End |
|---|---|---|---|---|
| 27 | 10.24 | 8.94 | | 1.1651 |
| 20 | 10.22 | 8.93 | | 1.1197 |
| 10 | 10.20 | 8.93 | | 1.0560 |
| 5 | 10.24 | 9.06 | | 1.0261 |

EXAMPLE 9

A seven day stability test was conducted with the sodium salt of Example 8 at a temperature of 78° C. in glass containers. The stability was determined by the change in molecular weight loss over the period. Although some molecular weight loss is indicated in the data, chromatographic analysis of the aged samples did not indicate the appearance of aspartic acid in the test samples. The results of the test are reported below in Table VIII.

TABLE VIII

| | conc | | | | | | | | | |
|---|---|---|---|---|---|---|---|---|---|---|
| | 27% | | 20% | | 10% | | 5% | | control | |
| Day | Med. Wt | % Polym | Med. Wt | % Polym | mole. wt | % Poly m | Med Wt. | % Poly m | Med Wt | % Poly m |
| 0 | 9510 | 27.25 | 9510 | 19.69 | 9660 | 9.38 | 8960 | 4.77 | 5360 | 28.5 |
| 1 | 9250 | 26.53 | 9250 | 18.52 | 9110 | 10.02 | 8715 | 5.29 | 5520 | 28.1 |
| 2 | 8936 | 27.4 | 8807 | 20.5 | 8679 | 10.4 | 8250 | 5.3 | 5410 | 28.1 |
| 4 | 8580 | 27.5 | 8460 | 19.4 | 7930 | 9.8 | 7755 | 4.67 | 5320 | 28 |
| 7 | 8410 | 27.99 | 8410 | 20.86 | 7930 | 10.53 | 6640 | 5.25 | 5470 | 28.1 |

EXAMPLE 10

A four-ball wear test (ASTM D2783) was conducted employing a 28% aqueous solution of sodium polyaspartic acid salt. Also tested under the same conditions was a commercially available water based metal working fluid sold under the tradename Acusol from Rohm & Haas, diluted to 28% by weight in water. Water alone was also tested for comparison. The load was 40 Kg, the speed was 625 rpm. The test was run at 75.5° C. for one hour. An average of three readings is reported below in Table IX.

TABLE IX

| Lubricant | Polyaspartic | Acusol | Water |
|---|---|---|---|
| Scar Diameter (mm) | 0.54 | 0.50 | 0.70 |

EXAMPLE 11

The metal working fluids of this invention were compared to other fluids in the Four-ball wear test run at 40 Kg load, 1200 rpm and at initial temperature of 120° C. for one hour. Four concentrations of the sodium salt of polyaspartic acid as well as alkyl amine salts of polyaspartic acid were compared with other amino acids, commercially available water based fluids, lubricating oil and water. The results of the test are reported below in Table X.

TABLE X

| Lubricant | Concen. (wt. %) | Scar Dia. (mm) | Final Temp °F. |
|---|---|---|---|
| Polyaspartic | 28 | 1.39 | 128 |
| Acid | 20 | 1.38 | 165 |
| | 10 | 1.92 | 190 |
| | 5 | 1.78 | 190 |
| C18 amine | Ksalt | | |
| | 5 mole % | 1.30 | 135 |
| C12 amine | 10 mole % | 0.84 | 120 |
| C3 amine diol | 10 mole % | 1.06 | 120 |
| PVA[2] | 14 | 1.25 | 160 |
| Acusol 445N[3] | 28 | 0.98 | 120 |
| Water | | 1.47[4] | 210 |
| Hocut4284b | | 1.07 | 142 |
| Eng. Lub | | 1.00 | 120 |
| Polyasp Phos | | 1.17 | 120 |
| Acid 34,600 MW | | | |
| Triethanolamine | 100% | 1.06 | 120 |

[1]amine odor detected
[2]polyvinyl alcohol
[3]a polyacrylate
[4]test concluded after 20 min.

EXAMPLE 12

A lathe, LeBlond Makino model 15-544, was operated at 256 rpm with a carbide coated bit, a series of metal bars (black iron, mild steel, stainless steel and aluminum) were cut with the bit set to cut at a depth of 0.3125 cm. The lubricant employed was a 14% aqueous solution of polyaspartic acid (sodium salt) fed to the bit at the rate of 9.5 l/min. No ripping of the metal was observed and a smooth cut was obtained.

EXAMPLE 13

A series of four-ball tests were run employing various formulated aqueous solutions of polyaspartic acid (PAA). In Table XI below are shown the data obtained from the test wherein TSPP means tetrasodium pyrophosphate, CMC means carboxymethylcellulose, LB-400 is a commercially available water based fluid obtained from Rhone Poulenc containing polyoxethylene octadecenyl ether phosphate (CAS registry No. 00039466-69-2) and the surfactant is commercially obtained nonionic under the brand name Poly-Tergent, SLF-18. The results of the tests are shown below in Table XI. The amounts of components in Table XI are in weight percent. The viscosity is reported in centistokes at 37.7° C. and scar diameter is reported in mm.

TABLE XI

| test | | 1 | 2 | 3 | 4 | 5 | 6 | 7 | 8 |
|---|---|---|---|---|---|---|---|---|---|
| Form | PAA | 5% | 5% | 5% | 5% | 5% | 5% | 5% | 5% |
| | TSPP | | | | | 0.2 | 0.2 | 0.2 | |
| | MORPHOLINE | | | 0.2 | 0.2 | | | 0.2 | 0.2 |
| | CMC | | 6 | | 6.0 | | 6.0 | | 6.0 |
| | LB-400 | | | 0.2 | 0.2 | 0.2 | 0.2 | | |
| | Surfactant | | 0.2 | | 0.2 | 0.2 | | 0.2 | |
| Test Res | viscos 100° F. cst | 1.09 | 1737 | 1.13 | 1828 | 1.13 | 1804 | 1.12 | 2078 |
| | 4-ball test mm | 1.72 | 1.51 | 1.23 | 1.23 | 1.34 | 0.91 | 1.31 | 1.14 |
| | Δ temp °F. | boiled off | 95 | 50 | 40 | 45 | 50 | boiling | 80 |
| | | | | | | METAL TORE | METAL TORE | METAL TORE | METAL TORE |
| | Phoenix data | | | | | | | | |
| | 4 ball test mm | 1.51 | | | | | | | |
| | Δ Temp °F. | 99 | | | | | | | |

| test | | 9 | 10 | 11 | 12 | 13 | 14 | 14 | 16 | 17 |
|---|---|---|---|---|---|---|---|---|---|---|
| Form | PAA | 20% | 20% | 20% | 20% | 20% | 20% | 20% | 20% | 20% |
| | TSPP | | | | | 0.2 | 0.2 | 0.2 | 0.2 | |
| | MORPHOLINE | | | 0.2 | 0.2 | | | 0.2 | 0.2 | |
| | CMC | | 6.0 | | 6.0 | | 6.0 | | 6.0 | |
| | LB-400 | 0.2 | 0.2 | | | | | 0.2 | 0.2 | |
| | Surfactant | 0.2 | | 0.2 | | | 0.2 | | 0.2 | |
| Test Res | viscos 100° F. | 3.48 | 75.02 | 3.4 | 95.12 | 3.35 | 89.17 | 3.39 | 73.49 | 3.33 |
| | 4-ball test mm | 1.45 | 1.05 | 1.56 | 1.42 | 1.39 | 1.18 | 1.24 | 1.1 | 1.53 |
| | Δ temp °F. | 50 | 50 | 60 | 40 | 90 | 80 | 30 | 30 | 50 |
| | Phoenix data | | | | | | | | | 28% |
| | 4-ball test mm | | | | | | | | | 1.27 |
| | Δ Temp °F. | | | | | | | | | 52 |

Although the invention has been described in terms of specific embodiments which are set forth in considerable detail, it should be understood that this description is by way of illustration only and that the invention is not necessarily limited thereto since alternative embodiments and operating techniques will become apparent to those skilled in the art in view of the disclosure. Accordingly, modifications are contemplated which can be made without departing from the spirit of the described invention.

What is claimed is:

1. In a method of metal working wherein a lubricant is provided for said metal, the improvement which comprises providing an aqueous solution of a polyaspartic polymer selected from the group consisting of the acid, salt and amide thereof.

2. The method of claim 1 wherein the solution contains from about 5% to about 50%, by weight, of said polymer.

3. The method of claim 1 wherein the solution contains from about 5% to about 15% by weight, of said polymer.

4. The method of claim 1 wherein the solution contains an adjuvant.

5. The method of claim 1 wherein the metal working is cutting selected from the group consisting of threading, grinding and shaping.

6. The method claim 5 wherein the metal working is bending.

7. The method of claim 6 wherein the metal is a ferrous metal.

8. The method of claim 5 wherein the metal is non-ferrrous.

9. The method of claim 8 wherein the metal is brass.

10. The method of claim 5 wherein the metal working is threading.

11. The method of claim 10 wherein the metal is non-ferrous.

12. The method of claim 11 wherein the solution contains from about 5% to about 50% polyaspartic acid.

13. The method of claim 10 wherein the metal is a ferrous metal.

14. The method of claim 8 wherein the metal is aluminum.

15. The method of claim 13 wherein the solution contains from about 5% to about 50% polyaspartic acid.

* * * * *